US006412902B2

(12) United States Patent
Matsumoto et al.

(10) Patent No.: US 6,412,902 B2
(45) Date of Patent: Jul. 2, 2002

(54) PRINTING HEAD INSPECTING DEVICE AND METHOD FOR PRINTER

(75) Inventors: Nobuo Matsumoto; Eiichi Kito; Kiyotaka Kaneko; Yasuyuki Hosono, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/886,365

(22) Filed: Jun. 22, 2001

(30) Foreign Application Priority Data

Jun. 26, 2000 (JP) ..... 2000-190877

(51) Int. Cl.[7] ..... B41J 29/393; B41J 2/165

(52) U.S. Cl. ..... 347/19; 347/23

(58) Field of Search ..... 347/19, 20, 14, 347/23, 12, 40, 2, 5, 22, 104, 101, 105, 108

(56) References Cited

U.S. PATENT DOCUMENTS 5,831,644 A * 11/1998 Kato ..... 347/22
5,956,051 A * 9/1999 Davies et al. ..... 347/2
6,106,095 A * 8/2000 Jackson et al. ..... 347/5

* cited by examiner

*Primary Examiner*—John Barlow
*Assistant Examiner*—Charles W. Stewart, Jr.
(74) *Attorney, Agent, or Firm*—McGuireWoods LLP

(57) ABSTRACT

An ink jet printer includes an ink jet printing head, having plural recording elements arranged in a main scan direction. Feeder roller sets move continuous recording sheet relative to the printing head in a sub scan direction, to print an image to the continuous recording sheet. A printing head inspecting device for the printer is provided. A controller causes the feeder roller set to set first and second line positions of the continuous recording sheet sequentially at the printing head. While one of the first and second line positions is set at the printing head, the controller simultaneously drives recording elements in one of first and second groups into which the recording elements are grouped in the printing head, to print one check dot train to the continuous recording sheet. Thus, two check dot trains are printed in the first and second line positions. Each of the first and second groups includes plural recording elements intermittently arranged in the printing head. An inspection sensor detects the two check dot trains, to inspect whether the recording elements print at intended density.

25 Claims, 11 Drawing Sheets

PRINTING HEAD INSPECTING DEVICE AND METHOD FOR PRINTER

BACKGROUND OF THE INVENTION

1. Field of the Invention

The present invention relates to a printing head inspecting device and method for a printer. More particularly, the present invention relates to a printing head inspecting device and method for a printer capable of quickly discovering failure in a printing head.

2. Description Related to the Prior Art

An ink jet printer is known, and includes an ink jet printing head, which includes a group of nozzles for ejecting ink to recording material to print an image thereto. If the ink jet printer is repeatedly used, choking of ink is likely to occur in the nozzles. It is likely that an ejected amount of ink decreases. Furthermore, no ink may be ejected. This causes streaks or other unevenness in color or density to occur in a printed image.

In general, an operator observes the printed image, and if there are streaks with unevenness in color or density, changes over the ink jet printer to a head cleaning mode. The printer is cleaned to eliminate the choking of ink or abnormality in a direction of ejecting the ink. In a cleaning process, ink is caused to flow out of the nozzles at a high flow rate. Also, the nozzles are sucked externally to remove choking of ink. Furthermore, the periphery of the nozzles is wiped. It is, however, likely that an operator discovers the choking of ink too late. Images may be printed at a low quality due to the failure. If the printer is used by a user at home, no serious problem occurs even with drop in the image quality. However, if the printer is used commercially at a printing shop, failure in operation of the nozzles may cause serious problem due to occurrence of a great number of failing prints to be produced.

Recently, the ink jet printing head has the nozzles arranged at a very high density so as to produce prints with high quality by means of pixels in a small size. There is a problem in that designation of failing nozzles becomes more difficult according to the high density of the nozzles.

SUMMARY OF THE INVENTION

In view of the foregoing problems, an object of the present invention is to provide a printing head inspecting device and method for a printer capable of quickly discovering failure in a printing head with great ease.

In order to achieve the above and other objects and advantages of this invention, a printing head inspecting device for a printer is provided, the printer including a printing head, having plural recording elements arranged in a first direction, and a moving mechanism for moving one of the printing head and recording material relative to remainder thereof in a second direction, to print at least one image to the recording material. In the printing head inspecting device, a controller causes the moving mechanism to set plural line positions of the recording material sequentially at the printing head, and while one of the plural line positions is set at the printing head, simultaneously drives recording elements in one group among plural groups into which the recording elements are grouped in the printing head, to print one check dot train to the recording material, thereby plural check dot trains being printed in the plural line positions, wherein each of the plural groups includes plural recording elements intermittently arranged in the printing head. An inspection sensor detects the plural check dot trains, to inspect whether the recording elements print at intended density.

In a preferred embodiment, a printing head inspecting device for a printer includes a controller for causing the moving mechanism to set the printing head sequentially to plural line positions in the recording material, and for, while the printing head is set in one of the line positions, driving the recording elements in such a manner that one of the recording elements is driven, and that n adjacent recording elements thereof per the one recording element are kept turned off according to the arranging direction, to print a check dot train to include one dot per one blank as large as n adjacent dots, where n is an integer equal to or more than 1, and for driving the recording elements in the manner with a difference in the line positions and a difference in the recording elements, to print first to (n+1)th check dot trains respectively to include one dot per one blank as large as n adjacent dots. An inspection sensor detects the first to (n+1)th check dot trains, to inspect whether the recording elements print at intended density.

The plural line positions are located upstream or downstream from the at least one image in the recording material.

The controller, according to an output from the inspection sensor, designates failing ones of the plural recording elements associated with pixels with the density being low in the plural check dot trains.

The at least one image is plural images, and the recording material is continuous recording sheet or recording sheet strip.

The inspection sensor includes plural photo receptor elements arranged in the crosswise direction, for reading the density of each of the plural check dot trains. Furthermore, a scanning mechanism moves the inspection sensor in the arranging direction, to scan the plural check dot trains by the pixels.

The plural photo receptor elements are arranged at a pitch of the plural check dot trains.

In a preferred embodiment, the inspection sensor includes a single photo receptor element. Furthermore, a scanning mechanism moves the inspection sensor in the arranging direction. While the recording material is moved in the crosswise direction, the inspection sensor scans the plural check dot trains on the recording material.

In another preferred embodiment, the inspection sensor includes plural photo receptor elements arranged in the arranging direction, for, while the recording material is moved in the crosswise direction, reading the density of the plural check dot trains by pixels.

The plural photo receptor elements are arranged at a pitch of the recording elements.

In a further preferred embodiment, the plural photo receptor elements are arranged at a pitch greater than a pitch of the recording elements. Furthermore, a scanning mechanism moves the inspection sensor in the arranging direction according to the pitch of the recording elements. While the recording material is moved in the crosswise direction, the inspection sensor scans the plural check dot trains on the recording material.

In an additional preferred embodiment, n=1, the first check dot train includes dots printed by recording elements of odd numbers among the recording elements, and the second check dot train includes dots printed by recording elements of even numbers among the recording elements.

In still another preferred embodiment, n=3, and the plural check dot trains are first to fourth check dot trains.

The printing head is an ink jet printing head, the recording elements are nozzles. The plural check dot trains are adapted to inspection of a state of the nozzles to eject ink.

According to another aspect of the invention, a printing head inspecting device includes a controller for causing the moving mechanism to set the printing head sequentially to plural line positions in the recording material, and for, while the printing head is set in one of the line positions, driving the recording elements in such a manner that m adjacent recording elements of the recording elements according to the arranging direction are driven, and that n of the recording elements per the m recording elements are kept turned off, to print a check dot train to include m adjacent dots per one blank as large as n dots, where m is an integer equal to or more than 2, and n is an integer equal to or more than 2 and equal to or more than m, and for driving the recording elements in the manner with a difference in the line positions and a difference in the recording elements, to print first to (n+1)th check dot trains respectively to include m adjacent dots per one blank as large as n dots. An inspection sensor detects the first to (n+1)th check dot trains, to inspect whether the recording elements print at intended density.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
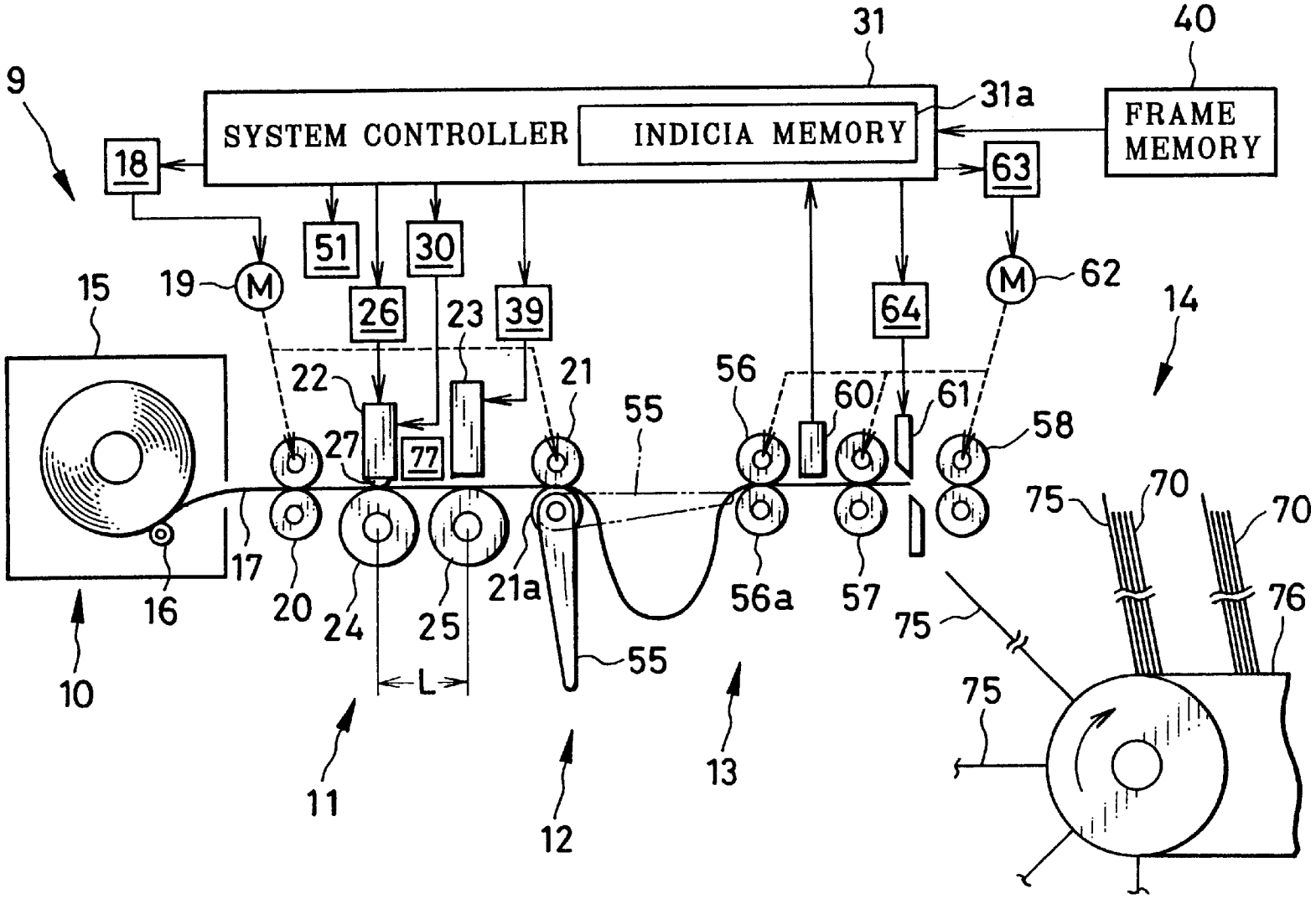
FIG. 1 is an explanatory view in elevation, illustrating an ink jet printer.

In FIG. 1, an ink jet printer 9 is illustrated, and is constituted by a sheet supply unit 10, an image forming component 11, a sheet reservoir 12, a cutter 13 and a sorter 14. A recording sheet magazine 15 is provided with a supply roller 16, which is rotated by the sheet supply unit 10 to unwind and advance continuous recording sheet 17 as recording material from the recording sheet magazine 15. The continuous recording sheet 17 is supplied to the image forming component 11. In the present embodiment, the continuous recording sheet 17 has a width of approximately 210 mm according to the A4 format of 210×297 mm. Each print to be obtained from the continuous recording sheet 17 has the A4 format. Of course, the width of the continuous recording sheet 17 and the size of each image frame may be changed in a suitable manner.

The image forming component 11 is constituted by feeder roller sets 20 and 21, a preheating thermal head 22, and an ink jet printing head 23. The feeder roller sets 20 and 21 in combination operate as moving mechanism. A motor 19 is driven by a motor driver 18, and causes the feeder roller sets 20 and 21 to rotate in nipping the continuous recording sheet 17. The thermal head 22 and the printing head 23 are disposed between the feeder roller sets 20 and 21, and extend in a main scan direction M that is crosswise to feeding of the continuous recording sheet 17. There are platen rollers 24 and 25 disposed under the thermal head 22 and the printing head 23 for supporting the continuous recording sheet 17.

Figure 2:
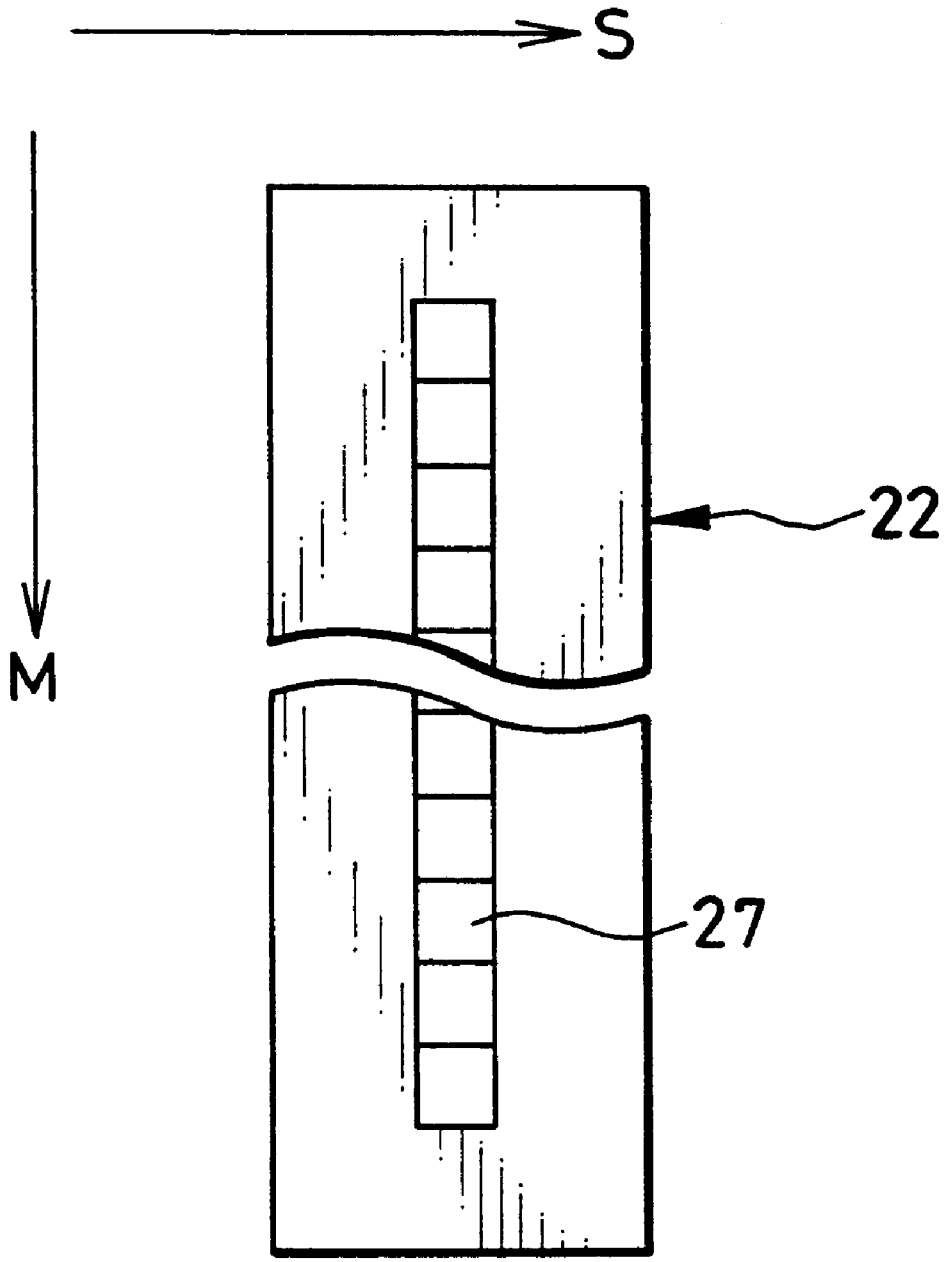
FIG. 2 is a plan illustrating a preheating thermal head.

A shifter mechanism 26 shifts the thermal head 22 up and down. During printing of the printing head 23, the shifter mechanism 26 keeps the thermal head 22 shifted down, so the continuous recording sheet 17 is squeezed between the thermal head 22 and the platen roller 24 to preheat the continuous recording sheet 17 with the heating elements. At the time of not printing, the shifter mechanism 26 keeps the thermal head 22 shifted up away from the continuous recording sheet 17. In FIG. 2, a great number of heating elements 27 are disposed in the thermal head 22 and arranged in the main scan direction M. Preheating by use of the thermal head 22 is for the purpose of drying ejected ink on the continuous recording sheet 17 at a short time upon printing with the ink.

In FIG. 1, a preheating head driver 30 drives and controls the heating elements 27 in the thermal head 22. A system controller 31 sends the preheating head driver 30 drive data determined for each of the heating elements 27. The drive data is determined according to an ejected amount of ink from the printing head 23. For pixels of which the ejected amount of ink is high, relatively high preheating heat energy is applied to the pixels by the heating elements 27 in the thermal head 22. For pixels of which the ejected amount of ink is low, relatively low preheating heat energy is applied to the pixels by the heating elements 27 in the thermal head 22.

In view of efficient cooling after preheating, the distance L between the thermal head 22 and the printing head 23 should be as small as possible. According to the distance L, a position in the continuous recording sheet 17 for starting preheating of the thermal head 22 is determined. Also, a position in the continuous recording sheet 17 for starting printing of the printing head 23 is determined. Feeding and printing are controlled so that printing with the printing head 23 is started in the printing starting position.

Figure 3:
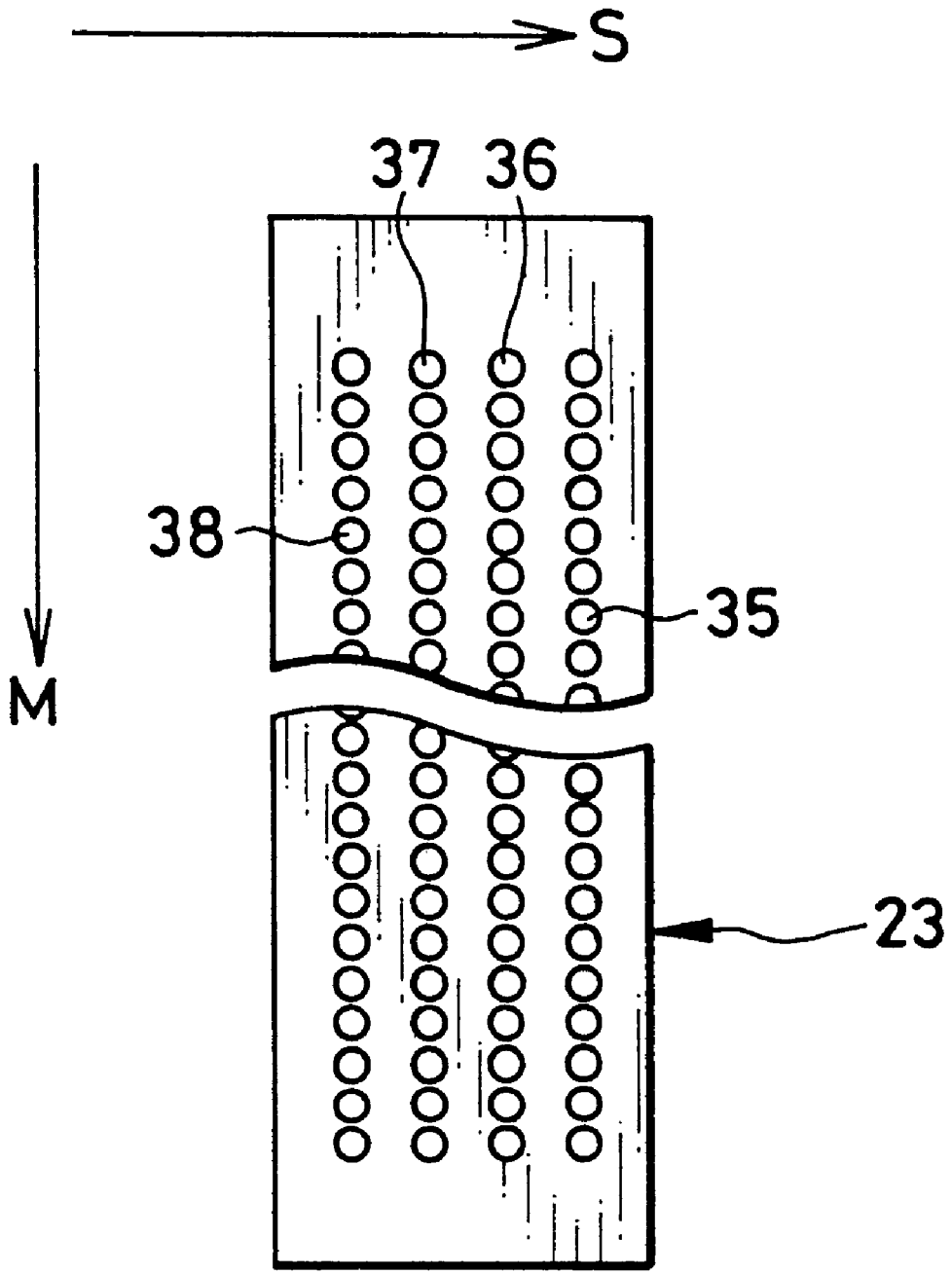
FIG. 3 is a plan illustrating an ink jet printing head.

In FIG. 3, the printing head 23 includes arrays of nozzles 35, 36, 37 and 38 as recording elements for line printing of four colors including yellow, magenta, cyan and black colors. As is well-known in the art, the printing head 23 accommodates piezoelectric elements disposed in an ink flowing path close to the nozzles 35, 36, 37 and 38. The ink flowing path is shortened or extended by the piezoelectric elements, to eject and supply ink.

As illustrated in FIG. 1, a printing head driver 39 drives and controls each of piezoelectric elements. The printing head driver 39 sends the piezoelectric elements a drive signal determined according to image data. The system controller 31 is connected with the printing head driver 39. A frame memory 40 is connected with the system controller 31, which writes image data to the frame memory 40, the image data being input by an image reader device or image output device.

The system controller 31 determines drive data for the piezoelectric elements in the nozzles 35–38 according to image data of the respective colors. The drive data is sent to the printing head driver 39. Then the system controller 31 causes the printing head driver 39 to drive the piezoelectric elements in synchronism with feeding of the continuous recording sheet 17. Ink droplets in a size and a number determined according to the image data is ejected toward the continuous recording sheet 17, and deposited to the continuous recording sheet 17. Therefore, a full-color image is printed to the continuous recording sheet 17 with ink of yellow, magenta, cyan and black colors.

In the present embodiment, both the dot diameter control and dot density control are used for expressing gradation so as to produce a print with high quality. However, only one of the dot diameter control and dot density control may be used. The arrays of the nozzles or printed lines are arranged at the regular pitch in the sub scan direction S. Image data for driving the piezoelectric elements are output according to differences of the lines of the colors in the sub scan direction S. Ink droplets for the four colors are deposited to the same position irrespective of the arrangement of the nozzles 35–38.

Figure 4:
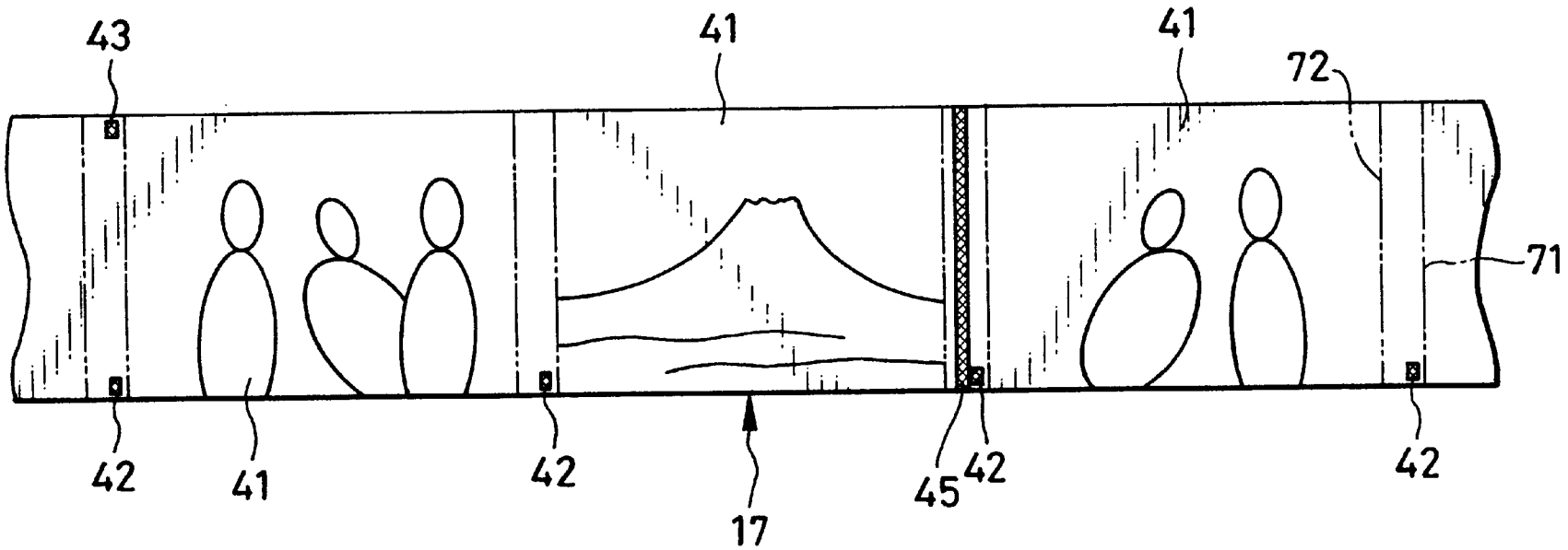
FIG. 4 is a plan illustrating continuous recording sheet with images printer thereon.

An indicia memory 31*a* stores data for creating indicia. The system controller 31 controls printing of a cutting indicia 42 and a sorting indicia 43 along borderlines of image frames 41 as illustrated in FIG. 4 according to the indicia creating data. In the present embodiment, the sorting indicia 43 is determined distinct from the cutting indicia 42 by positioning opposite thereto with reference to the main scan direction M.

Furthermore, data for creating a head check pattern 45 is stored in the indicia memory 31*a* of the system controller 31. The system controller 31, when in a setup mode immediately after powering the printer, prints the head check pattern 45 to a front edge of the continuous recording sheet 17 together with the cutting indicia 42. See FIG. 5.

Figure 5:
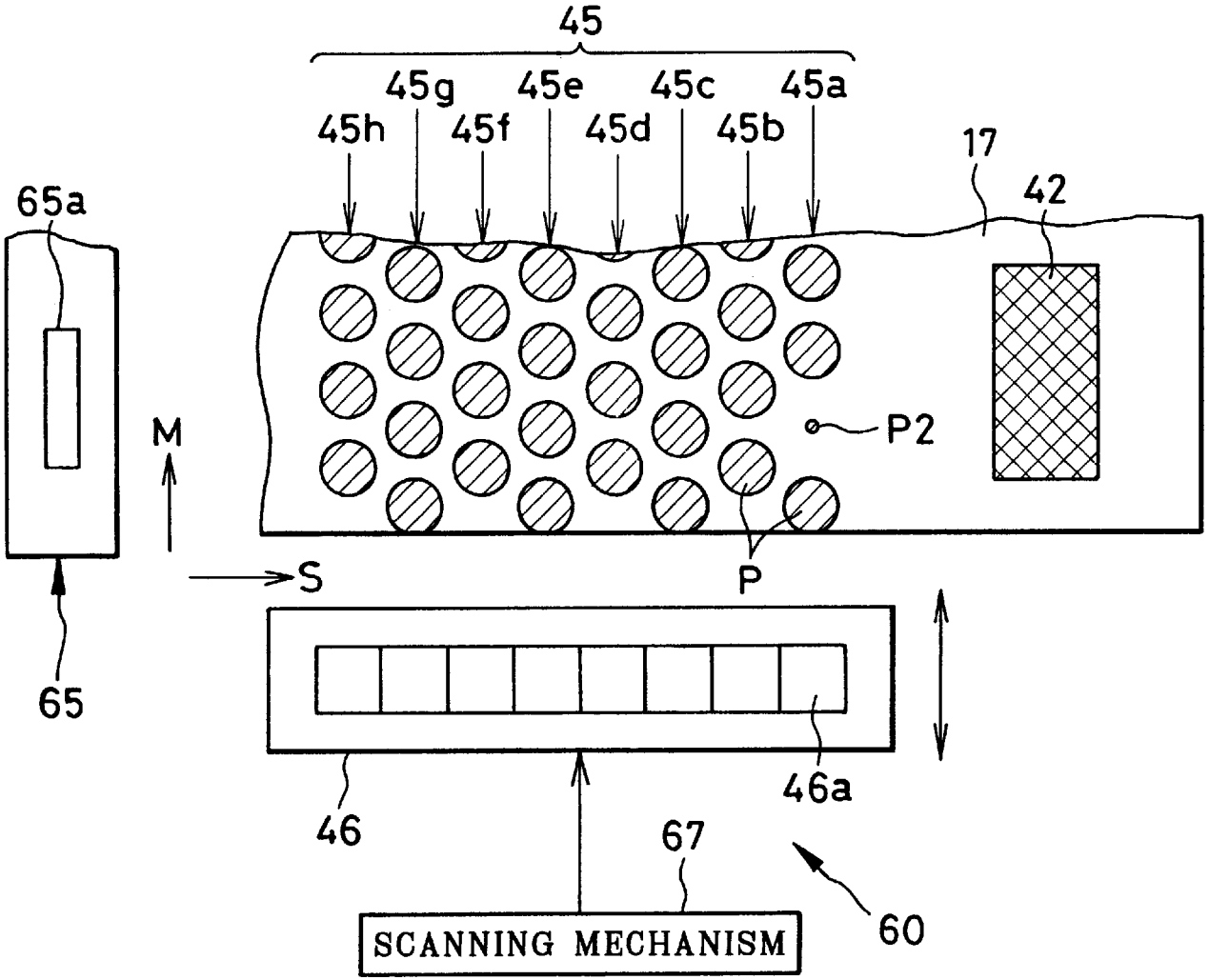
FIG. 5 is an explanatory view in plan, illustrating a head check pattern with the continuous recording sheet, an inspection sensor and an indicia sensor.

In FIG. 5, the head check pattern 45 is illustrated in enlargement. The head check pattern 45 is constituted by eight check dot trains 45*a*, 45*b*, 45*c*, 45*d*, 45*e*, 45*f*, 45*g* and 45*h*. Each of the check dot trains 45*a*–45*h* includes dots or pixels P arranged in the main scan direction M. The check dot trains 45*a*–45*h* are arranged in the sub scan direction S at a regular pitch that is equal to the pitch of the dots or pixels P. In the present embodiment, the pitch is twice as long as the size of each nozzle. The dots or pixels P are printed one per a space of two. The number of the check dot trains is two per each one color. The pixels P are printed at the highest density. It is to be noted that pixels P may be printed at middle or low density. Furthermore, it is possible to print the check dot trains by driving one nozzle per three, four or so. See FIGS. 6–9. Accordingly, the number of the check dot trains can be three, four or so.

As a gap occurs between pixels P associated with nozzles to be inspected, it is easy to grasp relationships between the pixels P and the nozzles 35–38 having printed those. An inspection sensor 46 in a form of line sensor reads the head check pattern 45 as will be described later in detail. If density of photo receptor elements 46*a* in the inspection sensor 46 is lower than that of the density of the pixels P, the pixels P are printed with gaps formed between them. This is effective in easily and reliably associating the nozzles 35–38 with the pixels P.

In FIG. 1, there is a pulse generator 51 connected with the system controller 31 for detecting an amount of feeding the continuous recording sheet 17. The pulse generator 51 contacts the continuous recording sheet 17, and generates pulses in the number proportional to the feeding amount of the continuous recording sheet 17. The system controller 31 counts the number of the pulses from the pulse generator 51, and obtains the feeding amount per unit time. According to the feeding amount, the system controller 31 determines timing of driving the recording sheet 22 and the printing head 23. Also, the system controller 31 compensates for drive data of the heating elements 27 according to the feeding speed of the continuous recording sheet 17. For example, the heat energy from the heating elements 27 is set higher according to an increase in the speed of the continuous recording sheet 17. The heat energy from the heating elements 27 is set lower according to a decrease in the speed of the continuous recording sheet 17. If the feeding speed of the continuous recording sheet 17 is very small and near to zero (0), the heat energy is set as zero to prevent unnecessary heating of the continuous recording sheet 17. It is to be noted that the motor 19 being used can be a stepping motor so the pulse generator 51 may not be used. Drive pulses for the stepping motor 19 can be counted to determine the timing described above.

The sheet reservoir 12 is constituted by the feeder roller set 21, a movable guide plate 55 and a feeder roller set 56. The feeder roller set 21 is an element in the image forming component 11, while the feeder roller set 56 is an element of the cutter 13. A driving roller 56*a* in the feeder roller set 56 is rotated at a higher peripheral speed than a driving roller 21*a* in the feeder roller set 21, to reserve one portion of the continuous recording sheet 17 by suspending the portion between the feeder roller sets 21 and 56. Note that the peripheral speed of the feeder roller set 56 can be equal to or higher than zero.

The movable guide plate 55 is movable pivotally about an axis about which the driving roller 21*a* rotates. The movable guide plate 55 guides a front edge of the continuous recording sheet 17 toward the cutter 13. An end of the movable guide plate 55, when the front edge of the continuous recording sheet 17 passes, is in a first position located close to an entrance of the feeder roller set 56 for guiding as indicated by the phantom line, and after the front edge of the continuous recording sheet 17 passes, is in a second position for reserving the continuous recording sheet 17 in a looped manner as indicated by the solid lines. As the portion of the continuous recording sheet 17 is suspended in the space defined by retracting of the movable guide plate 55 in the second position, the continuous recording sheet 17 is reserved.

The cutter 13 is constituted by the feeder roller set 56, feeder roller sets 57 and 58, a check dot train reader 60 and cutter blades 61. A motor 62 causes the feeder roller sets 56–58 to rotate. A motor driver 63 is controlled by the system controller 31, and drives the motor 62. A cutter driver 64 is controlled by the system controller 31, and drives the cutter blades 61 to cut the continuous recording sheet 17 along borderlines between image frames to remove portions with the cutting and sorting indicia 42 and 43. Thus, prints 70 with the image frames are produced.

In FIG. 5, the check dot train reader 60 is constituted by an indicia sensor 65, the inspection sensor 46 and a scanning mechanism 67. A photo receptor element 65*a* is included in the indicia sensor 65, detects the cutting indicia 42 and the sorting indicia 43, and sends an indicia detection signal to the system controller 31. In the present embodiment, the sorting indicia 43 is discerned from the cutting indicia 42 according to their positions. An indicia disposed at a first lateral edge of the continuous recording sheet 17 is determined as cutting indicia. An indicia disposed at a second lateral edge of the continuous recording sheet 17 is determined as sorting indicia.

In response to signals of detecting the cutting and sorting indicia 42 and 43, the system controller 31 controls rotation of the motor 62 and positions borderlines of the continuous recording sheet 17 at the cutter blades 61. In FIG. 4, cutting lines 71 and 72 are used for cutting of the continuous recording sheet 17 by the cutter blades 61 in operation at two times. Thus, the cutting and sorting indicia 42 and 43 are cut away from the continuous recording sheet 17, to obtain the prints 70 having respectively the image frames 41. After the cutting, each tray 75 collectively receives the prints 70 in a stacked manner. In response to the detection signal of the sorting indicia 43, the system controller 31 controls the sorter 14 and sets a new one of the trays 75 in a print dropping position. The prints 70 are inserted in the trays 75 per group according to each request for printing. Series of the prints 70 are grouped.

A conveyor belt 76 is included in the sorter 14, and provided with the numerous trays 75 arranged at a predetermined pitch. According to a detection signal of the sorting indicia 43, the conveyor belt 76 is driven and turned by an amount of the pitch of the trays 75, a succeeding one of which is set in the position for receiving drop of prints.

In the setup mode immediately after powering, the system controller 31 reads the check dot trains 45*a*–45*h* printed at the front edges of the continuous recording sheet 17 by means of the check dot train reader 60. In response to a detection signal of the image frames 41, the system controller 31 stops to position the check dot trains 45*a*–45*h* at a scanning line of the inspection sensor 46. The photo receptor elements 46*a* in the inspection sensor 46 are arranged in the sub scan direction S. A pitch of the photo receptor elements 46*a* is equal to that of printing the check dot trains 45*a*–45*h*. The scanning mechanism 67 moves the inspection sensor 46 in the main scan direction M with parallelism.

The system controller 31 receives a detection signal from the inspection sensor 46 in synchronism with movement of the inspection sensor 46 in the main scan direction M by the scanning mechanism 67. According to the detection signal, the system controller 31 obtains density of each pixel P. If the density is equal to or less than reference density being predetermined, then a nozzle having printed the pixel P is determined as failing nozzle. For example, density of the second pixel P2 in the check dot train 45*a* is very low in FIG. 5. Therefore, the nozzle No. 3 corresponding to the second pixel P2 is detected as a failing nozzle.

Upon detection of failing nozzles, those are subjected to cleaning operation. For cleaning, at first the continuous recording sheet 17 is returned. The failing nozzles are caused to eject ink at a higher flow rate than is ordinary toward printing regions adjacent to the check dot trains 45*a*–45*h*. Similarly, the check dot train 45*a* is printed by the nozzles including some failing nozzles. The check dot train 45*a* is read to judge whether choking of the failing nozzles is eliminated or not. In the present embodiment, the continuous recording sheet 17 is returned at a predetermined amount to set a printing region adjacent to the check dot trains 45*a*–45*h* for printing. The ink is ejected for cleaning. Wasteful use of the continuous recording sheet 17 is prevented. However, it is possible to omit the returning operation of the continuous recording sheet 17.

If failure of a nozzle is detected even after cleaning failing nozzles, then an alarm signal is generated by an alarm signal generator to inform an operator of choking with ink. In the case of this alarm signal, a special cleaning mode is designated by an operator to clean the nozzles. For example, heating elements (not shown) are operated in the special cleaning mode, and apply heat to ink contained in the nozzles, which are caused to eject the heated ink to conduct efficient cleaning. Note that, instead of cleaning by ejection of ink, suction or wiping of ink may be used for cleaning. Also, suction or wiping of ink may be added to ejection of ink. A recovery treating unit 77 is provided and operates for sucking the ink. The printing head 24 is shifted by the recovery treating unit 77 to a recovery position, where a suction head is set at the printing head 24 to clean the nozzles by sucking the ink. Also, the recovery treating unit 77 may have an ink wiper, which wipes ink away from the nozzles to clean the printing head 24. The ink wiper operates for cleaning as an alternative element in the recovery treating unit 77 instead of the suction head. If choking with ink still remains even after the cleaning process, then the ink jet printing head is replaced with a new printing head.

The operation of the embodiment is described now. When the printer is powered, the system controller becomes in the setup mode. At first, the check dot trains 45*a*–45*h* are printed to a front edge of the continuous recording sheet 17 by the printing head 23 as illustrated in FIG. 5. To be precise, nozzles of odd numbers included in the nozzles 35 are driven to print the check dot train 45*a* of the black color. Then the continuous recording sheet 17 is fed at a regular feeding amount, before nozzles of even numbers included in the nozzles 35 are driven to print the check dot train 45*b* of the black color. Similarly, nozzles of odd numbers included in the nozzles 36 are driven to print the check dot train 45*c* of the yellow color. Nozzles of even numbers included in the nozzles 36 are driven to print the check dot train 45*d* of the yellow color. Also, the check dot trains 45*e* and 45*f* are printed by the nozzles 37 in the magenta color. The check dot trains 45*g* and 45*h* are printed by the nozzles 38 in the cyan color.

The head check pattern 45 having the check dot trains 45*a*–45*h* is moved into a section of the cutter 13, where the check dot train reader 60 reads density of the respective pixels P of the check dot trains 45*a*–45*h*. If the density is equal to or lower than reference density, then the system controller 31 judges that a nozzle having printed the one of the pixels P is a failing nozzle. If failing nozzles are detected, then all the nozzles are cleaned by ejection of ink. Among all the nozzles, the ejection of ink through the failing nozzles is at a higher ejected amount of ink and at a higher flow rate through those. After this cleaning of the nozzles, the check dot trains 45*a*–45*h* are printed for the second time by all the nozzles including the failing nozzles. Then failure of the nozzles is checked again.

If failure of nozzles in operation is detected even after cleaning, then an alarm signal is generated, to inform an operator of the choking of ink. When the operator recognizes the alarm signal, then he or she designates a special cleaning mode that is predetermined. According to the special cleaning mode, the nozzles are cleaned according to a sequence determined in view of printer maintenance.

If there is no failing nozzle as a result of head checking, then a printing starting key is depressed to start printing an image. The thermal head 22, prior to printing, applies preheating heat energy to unit printing regions according to ejected amounts at which ink will be provided. Then the printing head 23 ejects ink to the continuous recording sheet 17, to print a full-color image. The ink can be dried efficiently, because the continuous recording sheet 17 has been preheated.

In FIG. 4, the cutting indicia 42 is printed at a borderline of the image frames 41. Also, the sorting indicia 43 is printed at a beginning or end of a series of images for one printing request. The cutter 13 cuts away a portion including the cutting indicia 42 or the sorting indicia 43 from the continuous recording sheet 17 by cutting along the cutting lines 71 and 72 in response to a detection signal of detecting the cutting indicia 42 or the sorting indicia 43.

At the start of printing, the cutting indicia 42 has been printed in a portion along a front edge of the image frames 41. Now, the front portion along the borderline of the image frames 41 is cut away. If the sorting indicia 43 is detected, the image is cut away in the position of the sorting indicia 43 similarly to the cutting indicia 42. In addition, a sorting signal is generated and output to inform an end of a series of the images related to a printing request. If there remains no image to be printed, then the final image frame is cut away. The front edge of the continuous recording sheet 17 is returned to the feeder roller set 21 in the image forming component 11, and becomes ready for printing.

In the above embodiment, the inspection sensor 46 has the eight photo receptor elements 46*a*. However, the inspection sensor 46 may have four, two or one photo receptor element 46*a*. In the case of the four, the inspection sensor 46 can be moved to scan for two times to read the check dot trains 45*a*–45*h*. In the case of the two, the inspection sensor 46 can be moved for four times to read the check dot trains. In the case of the one, the inspection sensor 46 can be moved for eight times to read the check dot trains.

Figure 6:
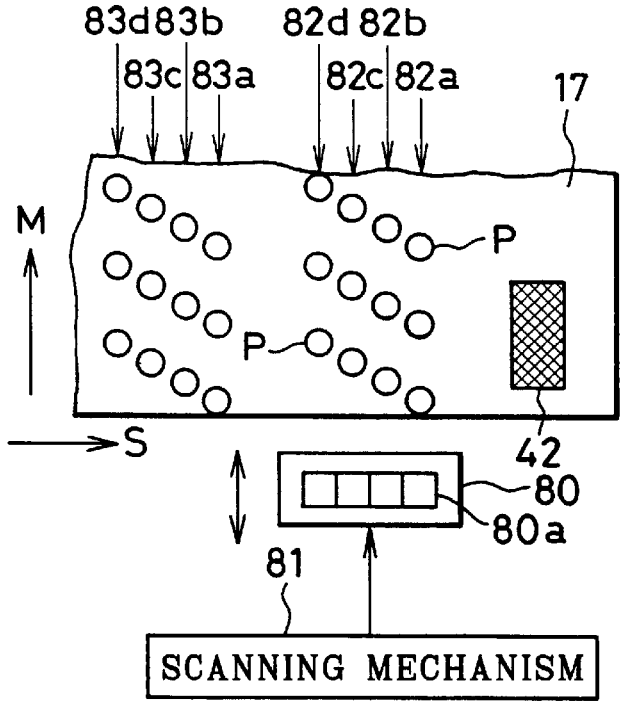
FIG. 6 is an explanatory view in plan, illustrating another preferred inspection sensor for scanning in the main scan direction, together with a head check pattern.

In the above embodiment of FIG. 5, the inspection sensor 46 is moved for scanning at one time in the main scan direction M to read the check dot trains 45*a*–45*h*. In FIG. 6, another preferred embodiment is depicted, in which an inspection sensor 80 includes four photo receptor elements 80*a*. A scanning mechanism 81 moves the inspection sensor 80 in the main scan direction M. So four check dot trains 82*a*–82*d* of each one of the colors are read at one time. Note that each of the check dot trains 82*a*–82*d* is printed by a nozzle train including nozzles that are selected from all the nozzles in the printing head in a manner that three unselected nozzles are disposed between each adjacent two of those. After reading the check dot trains 82*a*–82*d* of one color, the continuous recording sheet 17 is fed at a predetermined amount. Then check dot trains 83*a*–83*d* of a second color are read. Finally, four head check patterns of the four colors are read, the head check patterns having 16 check dot trains.

Figure 7:
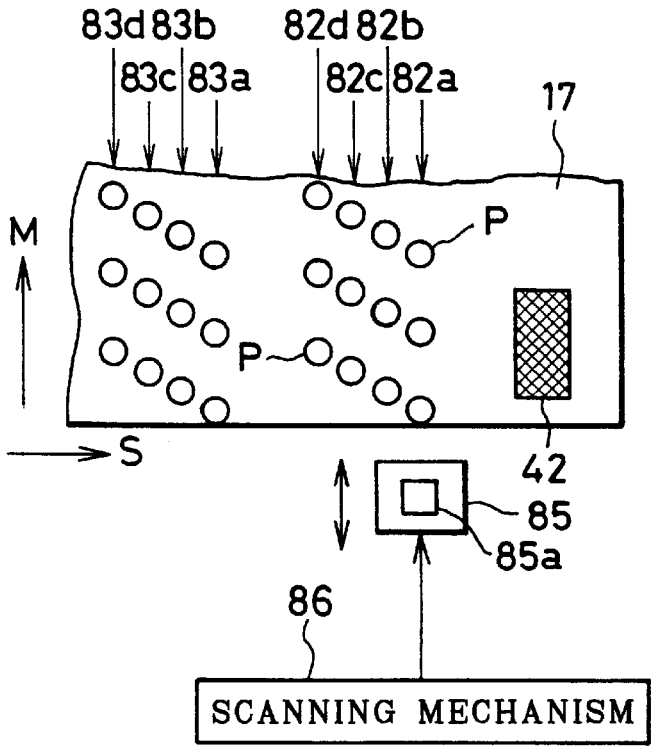
FIG. 7 is an explanatory view in plan, illustrating still another preferred inspection sensor having one photo receptor element.

In FIG. 7, another preferred inspection sensor 85 is depicted, which has a single photo receptor element 85*a*. A scanning mechanism 86 moves the inspection sensor 85 in the sub scan direction S to read the check dot trains 82*a*–82*d* and 83*a*–83*d* one train after another. After the reading, the continuous recording sheet 17 is fed by one line to read another dot train. The operation being repeated, all the check dot trains 82*a*–82*d* are read.

Figure 8:
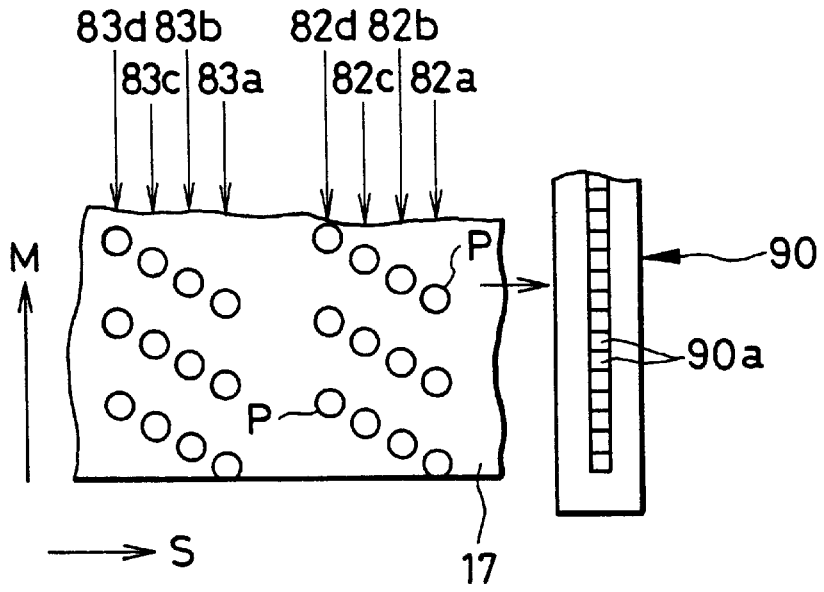
FIG. 8 is an explanatory view in plan, illustrating another preferred inspection sensor extending in the main scan direction.

In FIG. 8, another preferred embodiment is illustrated, in which an inspection sensor 90 is stationary. Plural photo receptor elements 90*a* are arranged in the main scan direction M in the inspection sensor 90, and read the check dot trains 82*a*–82*d* and 83*a*–83*d* in synchronism with feeding of the continuous recording sheet 17. As the check dot trains 82*a*–82*d* and 83*a*–83*d* are printed by nozzles selectively designated one per four nozzles in each nozzle array, the pixels P can be associated with nozzles having printed the pixels P. Failing nozzles can be recognized easily and reliably. Density of arranging the photo receptor elements 90*a* is equal to or higher than that of arranging the nozzles in view of precision in designating the failing nozzles.

Figure 9:
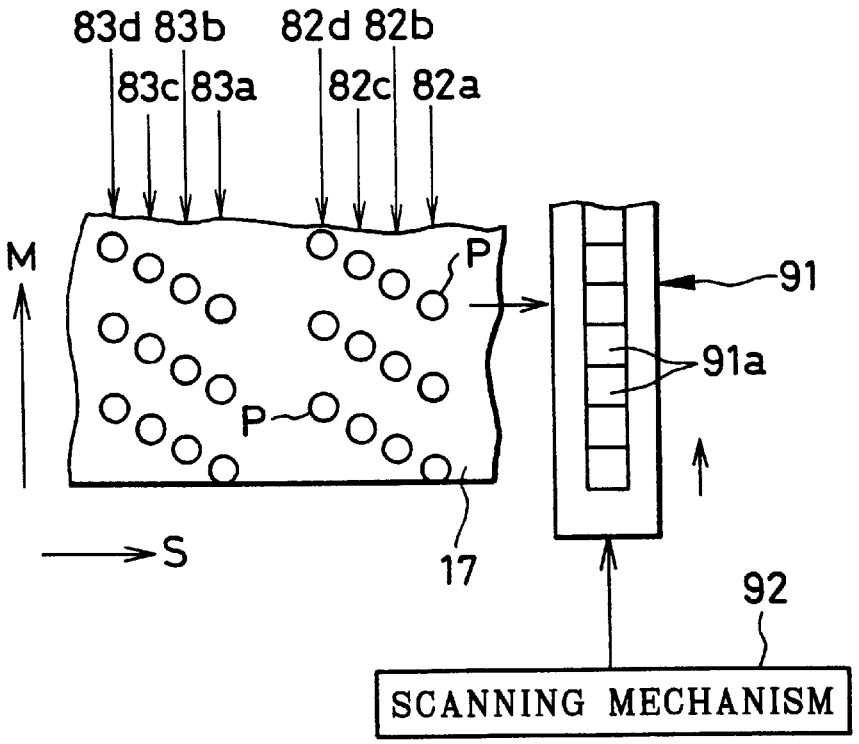
FIG. 9 is an explanatory view in plan, illustrating an inspection sensor having photo receptor elements in a greater size.

In FIG. 9, still another preferred inspection sensor 91 is depicted. Photo receptor elements 91*a* in the inspection sensor 91 are arranged at a lower density than that of the photo receptor elements 90*a* in FIG. 8. The density of the photo receptor elements 91*a* is low but enough to discern dots in each of the check dot trains 82*a*–82*d* and 83*a*–83*d*. A scanning mechanism 92 moves the inspection sensor 91 in the main scan direction M by a unit amount as great as a size of one nozzle. At first, one check dot train is read. Before reading a second check dot train, the inspection sensor 91 is shifted by the scanning mechanism 92 by the pitch of one nozzle. Density of the pixels P in the second check dot train can be read suitably, to designate failing nozzles.

In the above embodiment, the head check pattern 45 is printed in the setup mode immediately after powering the printer, to monitor the printing head state. However, any suitable sequence may be used to monitor the printing head state. For example, the head check pattern 45 may be printed in a beginning or ending position of a series of image frames according to a request for printing. Also, the head check pattern 45 may be printed in a beginning or ending position of every image frame. Furthermore, the head check pattern 45 may be printed at each time that a predetermined number of image frames are printed. For example, the head check pattern 45 may be printed whenever 10 image frames are printed, may be printed upon renewal of the continuous recording sheet 17, or may be printed at a lapse of 10 minutes or so and upon passage of a beginning position of an image frame. Also, the head check pattern 45 may be printed in a process of inspection at a factory for manufacturing the printer, to detect a failing printing head.

In the above embodiment, the check dot train reader 60 is incorporated in the printer. However, it is possible to dispose the check dot train reader 60 as a separate unit from the printer. For example, a flat bed scanner may be used as the check dot train reader 60 to designate failing nozzles.

Also, the printing head may be cleaned by ejection of ink through nozzles before printing the head check pattern 45. In cleaning the printing head, ink may be ejected to the continuous recording sheet 17. In addition, an ink receiving pad may be positioned to face the printing head, so as to receive ink ejected by cleaning.

In the above embodiments, a set of the plural check dot trains 45*a*–45*h* constitutes the head check pattern 45. However, the check dot trains 45*a*–45*h* may be disposed separately from one another. For example, each one head check pattern may include two plural check dot train for only one of the four colors. To be precise, a head check pattern for the black color may be printed at a first image. A head check pattern for the yellow color may be printed at a second image. A head check pattern for the magenta color may be printed at a third image. Then a head check pattern for the cyan color may be printed at a fourth image.

Note that heat energy of preheating with the thermal head 22 may be determined with differences between pixels, but also may be determined simply in an equal manner between pixels. Also, a heater may be incorporated in the platen roller instead of using the thermal head, to heat the continuous recording sheet 17 to dry the ink.

Furthermore, hot air may be applied to the ink for drying the ink after being ejected instead of preheating. Also, application of hot air may be added to the use of the preheating. For such a case, a hot air blow head may be used as a drier device to blow the recording sheet with hot air. Also, ink can be dried naturally with time without using preheating device or the drier.

Figure 10:
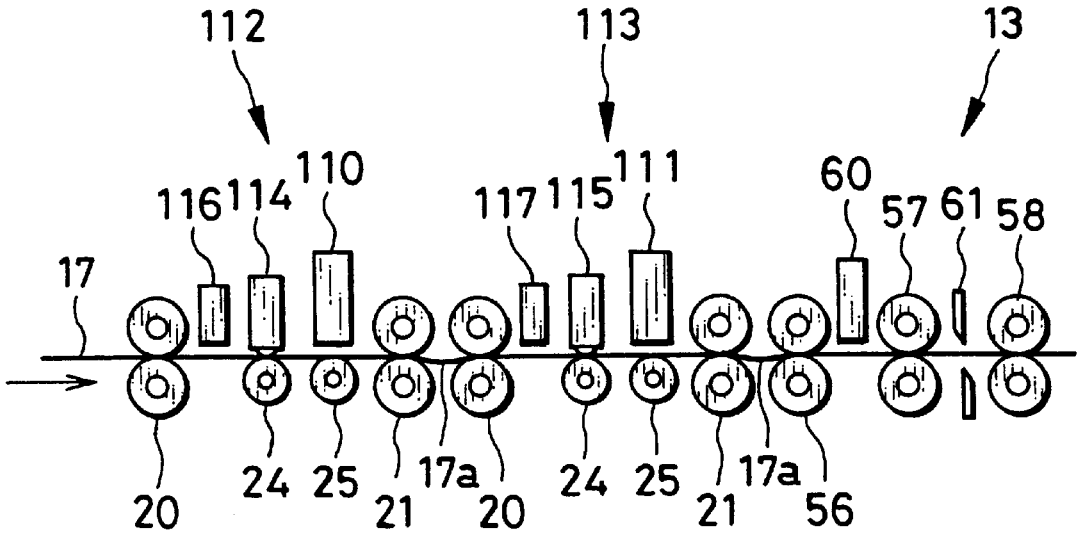
FIG. 10 is an explanatory view in elevation, illustrating another preferred ink jet printer having two printing heads.

In the above embodiments, the printing head 23 includes the arrays of the nozzles 35–38 as illustrated in FIG. 2. However, plural printing heads may be used in an ink jet printer. In FIG. 10, two image forming components 112 and 113 are provided in the ink jet printer. The image forming component 112 includes an ink jet printing head 110 having an array of nozzles for black ink. The image forming component 113 includes an ink jet printing head 111 having arrays of nozzles for yellow, magenta and cyan ink. Preheating thermal heads 114 and 115 are positioned upstream from respectively the printing heads 110 and 111 in the image forming components 112 and 113. Note that a front edge sensor 116 detects a front edge of the continuous recording sheet 17. An indicia sensor 117 detects the cutting indicia. The printing starting position is determined according to detection signals output by the front edge sensor 116 and the indicia sensor 117.

Loose portions 17*a* of the continuous recording sheet 17 are formed between the image forming components 112 and 113 and between the image forming component 113 and the cutter 13, and are adapted to avoiding transmission of minute movement of the continuous recording sheet 17 from one of the image forming components 112 and 113 to the remainder. The ejected amount of ink for a unit heating region of one heating element to the continuous recording sheet 17 is obtained according to the image data. Heat energy of the heating elements is controlled according to the ejected amount of the ink. If the ejected amount is high, the heat energy is determined high, to dry the ink in considerably short time.

Figure 11:
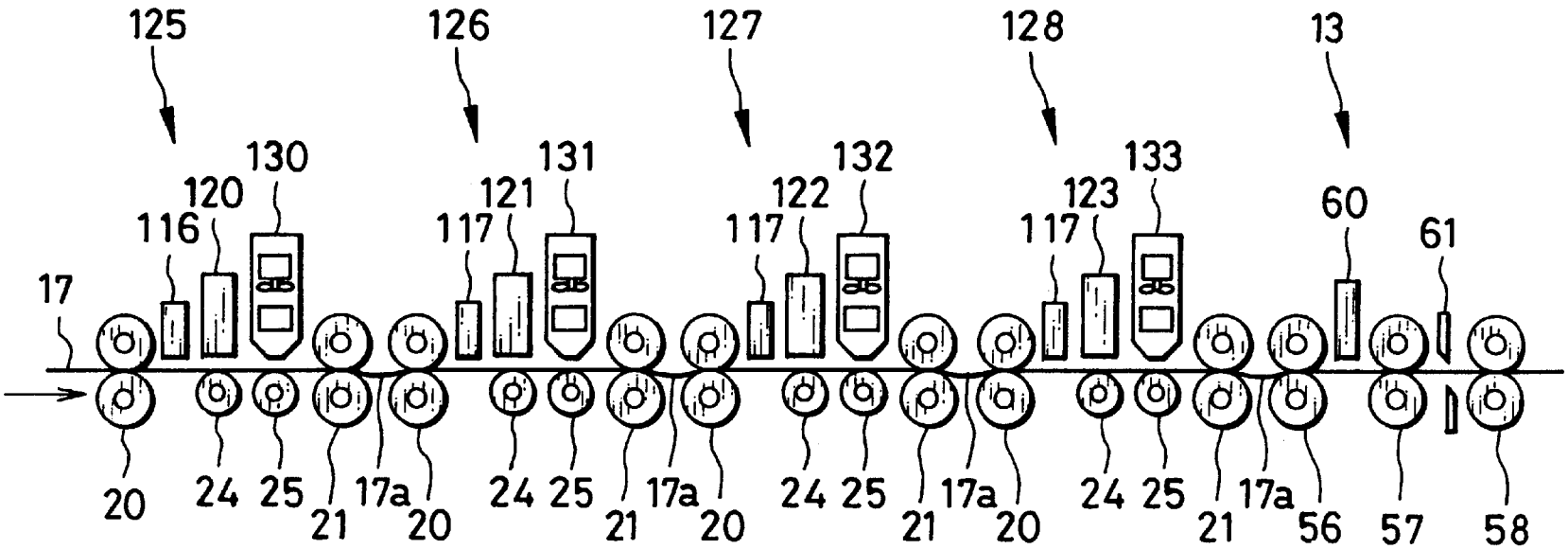
FIG. 11 is an explanatory view in elevation, illustrating a preferred ink jet printer having four printing heads.

In the present embodiment, the head check pattern 45 is printed in a beginning or ending position of each image frame by cleaning of the printing heads 110 and 111. See FIG. 5. Nozzles failing in operation are determined by reading the head check pattern 45 by the check dot train reader 60. Elements similar to those depicted in FIGS. 10 and 11 are designated with identical reference numerals in FIG. 1. Furthermore, a hot air blow head 130 illustrated in FIG. 11 may be used instead of the thermal heads 114 and 115. The hot air blow head 130 is positioned downstream from the printing heads 110 and 111 according to feeding of the continuous recording sheet 17.

In FIG. 11, another preferred ink jet printer is depicted, including four image forming components 125, 126, 127 and 128. Ink jet printing heads 120, 121, 122 and 123 are disposed in respectively the image forming components 125, 126, 127 and 128, and eject respectively black, yellow, magenta and cyan ink. Hot air blow heads 130, 131, 132 and 133 are positioned downstream from respectively the printing heads 120–123, and apply hot air to the continuous recording sheet 17 for drying ink. The printing heads 120–123 are driven to print the head check pattern 45 at a front or rear edge of each image. The head check pattern 45 is read by the check dot train reader 60 to designate failing nozzles. Note that, in the present embodiment, the thermal head can be positioned as depicted in FIG. 10 to preheat the continuous recording sheet 17 instead of the hot air blow heads 130–133. Ejected ink can be dried.

Furthermore, an ink jet printing head may have plural arrays of the nozzles 35 for black ink instead of the structure of FIG. 3. Also, ink jet printing heads may have plural arrays of the nozzles 36–38 for yellow, magenta and cyan ink. This being so, the number of linearly arranged nozzles with reference to the main scan direction becomes smaller. Thus, manufacture of the nozzles 35–38 can be still easier. It is also to be noted that plural ink jet printing heads may be combined, may have respectively a smaller size in the main scan direction, to constitute a single head group extending in the main scan direction crosswise to the feeding of the continuous recording sheet 17. It is possible in the plural printing heads to print a number of check dot trains each of which has pixels arranged intermittently, so as to designate failing nozzles with high precision.

Figure 12:
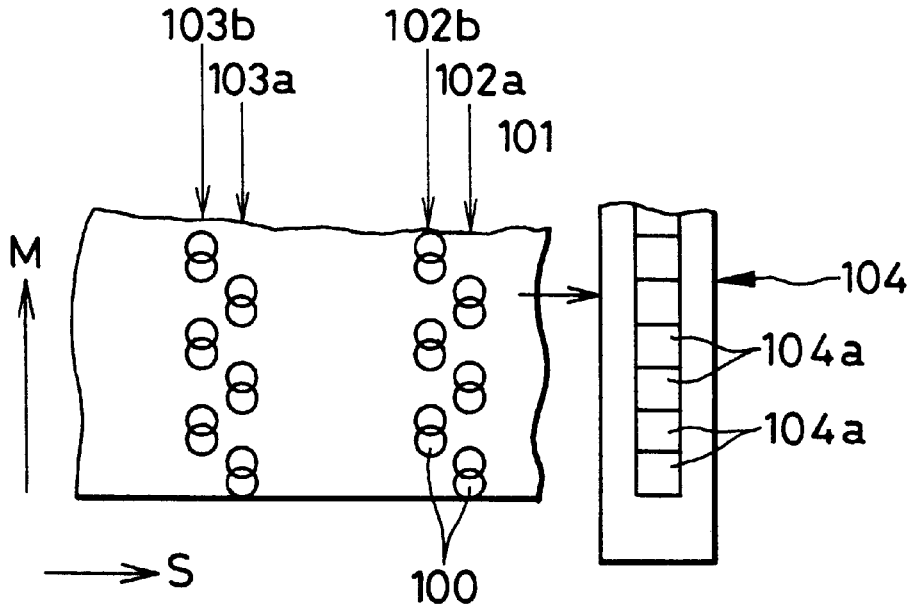
FIG. 12 is an explanatory view in plan, illustrating another preferred head check pattern having greater pixels.

In the above embodiment, each nozzle is associated with one of the pixels P. In FIG. 12, another preferred embodiment is illustrated, in which each one of pixels 100 are formed by two adjacent nozzles included in the printing head. In FIG. 12, there are check dot trains 102*a* and 102*b* and check dot trains 103*a* and 103*b* printed in continuous recording sheet 101. Each of those check dot trains is constituted by pixels each of which are formed by two adjacent dots and which are arranged at a pitch of four dots. In other words, two per four nozzles are driven to print each of those check dot trains. Note that, although the four check dot trains 102*a*, 102*b*, 103*a* and 103*b* are depicted, there are eight check dot trains, in other words two per each of the four colors. An inspection sensor 104 has photo receptor elements 104*a* or detecting areas, which correspond to the pixels. Among sub groups each of which has two nozzles, the inspection sensor 104 designates one of the sub groups including at least one failing nozzle. It is possible to modify the check dot trains in various manners. The recording elements in each one array in the printing head can be grouped into first to kth groups, each of which may be constituted by plural sub groups arranged intermittently within the printing head. Each of the sub groups may include a plurality of adjacent recording elements.

Figure 13:
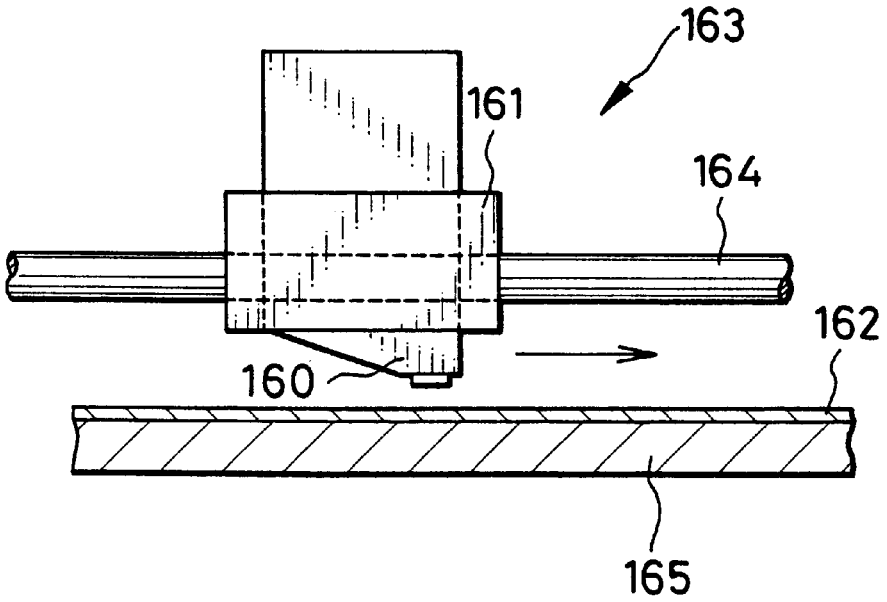
FIG. 13 is an explanatory view in elevation, illustrating an ink jet printing head of a serial printing type of ink jet printer.

In the above embodiments, the ink jet printers are a line printing type in which an image is printed one line after another in the direction crosswise to the feeding of the continuous recording sheet 17. Also, FIG. 13 illustrates an embodiment of ink jet printer 163 of a serial printing type. An ink jet printing head 160 is disposed in a head carriage 161 as moving mechanism, which moves the printing head 160 in the sub scan direction S crosswise to the long shape of continuous recording sheet 162 as recording material. Note that there is a guide rod 164 for guiding the head carriage 161 in the sub scan direction S of the continuous recording sheet 162. A platen 165 as second moving mechanism supports the continuous recording sheet 162, and moves the continuous recording sheet 162 in the main scan direction M.

To print a head check pattern in the ink jet printer 163, the head carriage 161 is moved in the main scan direction M. The nozzles are driven sequentially, to print dots or pixels in an inclined manner with reference to the continuous recording sheet 162.

Figure 14A:
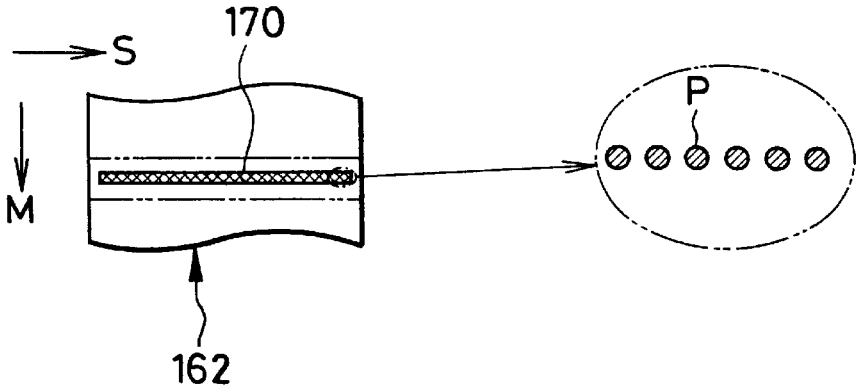
FIG. 14A is an explanatory view in plan, illustrating a head check pattern printer by the printing head of FIG. 13.
Figure 14B:
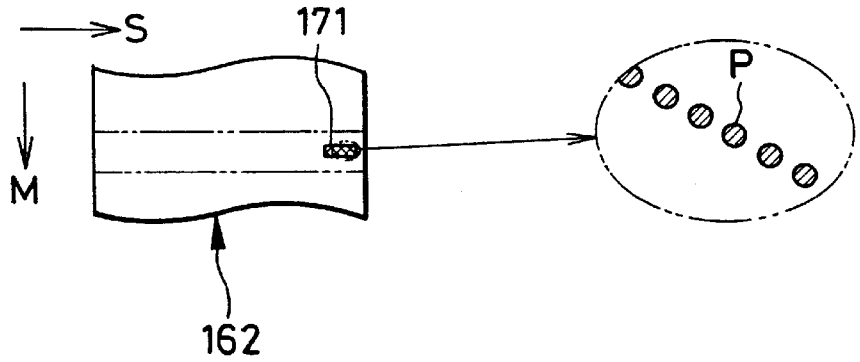
FIG. 14B is an explanatory view in plan, illustrating a head check pattern with dots arranged obliquely.
Figure 14C:
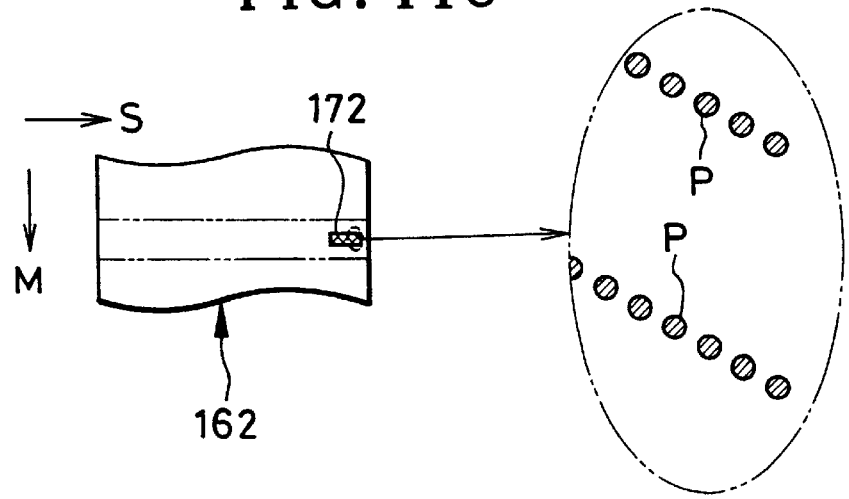
FIG. 14C is an explanatory view in plan, illustrating a head check pattern having two or more trains of dots.

In FIGS. 14A–14C, examples of head check patterns printed by the ink jet printer 163 are depicted. In FIG. 14A, the continuous recording sheet 162 is fed in the main scan direction M by one pixel. At the same time the head carriage 161 moves the printing head 160 in the sub scan direction S. The nozzles are driven sequentially so as to print a check dot train 170. The check dot train 170 is constituted by the pixels P distance from one another in the width direction of the continuous recording sheet 162.

In FIG. 14B, another check dot train 171 is depicted. The head carriage 161 moves the printing head 160 in the sub scan direction S without feeding the continuous recording sheet 162. In synchronism with the movement of the printing head 160, nozzles are driven serially one after another. The check dot train 171 is constituted by the pixels P arranged linearly in a direction oblique to the continuous recording sheet 162, and separate from one another.

In FIG. 14C, a check dot train 172 has a form typically used when the number of nozzles is very high. The nozzles are grouped in the main scan direction M into small groups according to a predetermined plural number. In each of small groups, the nozzles are driven one after another, so the check dot train 172 is obtained in a manner of plural inclined lines.

Note that, although not shown in detail in FIGS. 14A–14C, the printing head 160 has four arrays of the nozzles. If k check dot trains are printed per one color, the printing head 160 prints 4*k* check dot trains for all the four colors.

In the above serial printer, a cutting indicia or sorting indicia may be constituted by changing a pattern number, a printing position, a printing sequence of head check patterns and trial printed patterns.

In the above embodiments, failure in the nozzles in the printing head is detected by detecting choking of ink, failure of driving elements in the nozzles, failure in the driving circuit for the nozzles, or the like. It is to be noted that a printer of the invention may be a type other than an ink jet printer. Failure in recording elements in a certain printer may be detected by any suitable method. For example, a printer may be a thermal printer having a thermal printing head. To remove failure in failing heating elements in the printing head, drive data for the failing heating elements is compensated for by means of compensation data. Furthermore, a printer may be an exposing printing type which includes a printing head having an array of light-emitting elements, and which prints an image to an instant photo film by exposing the same with light controlled according to image data.

In the above embodiments, piezoelectric elements are used in the ink jet printing heads 23, 110, 111 and 120–123. However, other types of structures for ejecting ink may be used in ink jet printing. For example, a flow rate control diaphragm type may be used, in which piezoelectric elements are combined with diaphragms. A thermal ink jet printing may be used, in which heating elements heat liquid ink, generate bubbles and eject the ink. A continuous ink jet printing may be used, in which ink droplets are charged by means of electrodes, and deflection electrodes and separator plates are combined to eliminate and withdraw unnecessary ink droplets, and remaining ink droplets are ejected to the recording material. An electrostatic attraction ink jet printing may be used, in which high voltage is applied according to an image signal, and causes attraction of ink droplets to recording material. An ultrasonic ink jet printing may be used, in which ultrasonic waves are applied to vibrate liquid ink, and generate ink droplets. Furthermore, the colors of ink may be light magenta, light cyan and the like instead of the yellow, magenta, cyan and black colors.

In the above embodiments, a roll type of the continuous recording sheet is used. Also, a recording sheet of a limited size in a quadrilateral shape may be used. In each of the recording sheet, two or more images may be printed in series. The head check pattern is printed in a portion outside an effective image printing region in the recording sheet. Furthermore, a sorting indicia may be printed in the recording sheet. The outside portion having the head check pattern or sorting indicia is cut away by a cutter if required.

In the above embodiments, pixels of the check dot trains 45*a*–45*h*, 82*a*–82*h*, 83*a*–83*h* are printed at the fixed density. Furthermore, check dot trains may be printed at different values of density. This is effective because the nozzles can be checked for printing performance in different density ranges, for example at a high-density range, a low-density range, and a middle-density range. The printer of the invention may be a type in which light ink is used for refining gradation in a low-density range. Nozzles for the light ink may be inspected. In a manner similar to the above embodiments, check dot trains for head checking are printed. Failing nozzles are designated by detecting density of dots or pixels in the check dot trains. If light ink is used, printed density is lower than that by use of ink of an ordinary type. Thus, failing nozzles are designated by use of a different threshold value, a higher gain, or a different ejected amount of ink.

In the above embodiments, the nozzles to print pixels at one time for a check dot train are predetermined regularly in a manner of one of two adjacent nozzles, one of four adjacent nozzles, or the like. Furthermore, it is possible for the printing head to eject an ink droplet according to a predetermined sequence at least one time through each of all the nozzles. Sets of nozzles to be driven at one time can be disposed intermittently in the printing head.

For example, two check dot trains as one head check pattern may be printed by driving nozzles Nos. 1, 2, 5, 7, 8, 11, . . . , 6*p*-5, 6*p*-4 and 6*p*-1 (where p is an integer) to print a first check dot train, and by driving nozzles Nos. 3, 4, 6, 9, 10, 12, . . . , 6*p*-3, 6*p*-2 and 6*p* to print a second check dot train.

Also, a sequence of printing a head check pattern may be determined to drive nozzles at two times or more. For example, a first check dot train may be printed by driving nozzles Nos. 1, 2, 6, 7, . . . , 5*p*-4 and 5*p*-3. A second check dot train may be printed by driving nozzles Nos. 3, 4, 8, 9, . . . , 5*p*-2 and 5*p*-1. A third check dot train may be printed by driving nozzles Nos. 1, 5, 6, 10, . . . , 5*p*-4 and 5*p*. A fourth check dot train may be printed by driving nozzles Nos. 2, 3, 7, 8, . . . , 5*p*-3 and 5*p*-2. A fifth check dot train may be printed by driving nozzles Nos. 4, 5, 9, 10, . . . , 5*p*-1 and 5*p*. To inspect the head check pattern, detection of only the first to third check dot trains is sufficient. Otherwise, the second to fourth check dot trains, or the third to fifth check dot trains may be inspected. Furthermore, the first to third check dot trains may be printed in this pattern printing sequence without printing the forth and fifth check dot trains.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A printing head inspecting device for a printer including a printing head having an array of plural recording elements, and a moving mechanism for moving one of said printing head and recording material relative to a remainder thereof in a direction perpendicular to said recording elements, for printing at least one image to said recording material, said printing head inspecting device comprising:

a controller for causing said moving mechanism to set said printing head sequentially to plural line positions in said recording material, and for, while said printing head is set in one of said line positions, driving said printing head in such a manner that n adjacent recording elements thereof per said one recording element are kept turned off according to said arranging direction, to print a check dot train to include one dot per one blank as large as n adjacent dots, where n is an integer equal to or more than 1, and for driving said recording elements in said manner with a difference in said line positions and a difference in said recording elements, to print first to (n+1)th check dot trains respectively to include one dot per one blank as large as n adjacent dots: and an inspection sensor for detecting print densities of said first to (n+1)th check dot trains, to determine whether said recording elements are functioning properly.

2. A printing head inspecting device as defined in claim 1, wherein said plural line positions are located upstream or downstream from said at least one image in said recording material.

3. A printing head inspecting device as defined in claim 2, wherein said controller, according to an output from said inspection sensor, designates failing ones of said plural recording elements associated with pixels with said density being low in said plural check dot trains.

4. A printing head inspecting device as defined in claim 3, wherein said at least one image is plural images, and said recording material is continuous recording sheet or recording sheet strip.

5. A printing head inspecting device as defined in claim 2, wherein said inspection sensor includes plural photo receptor elements arranged in said crosswise direction, for reading said density of each of said plural check dot trains;

further comprising a scanning mechanism for moving said inspection sensor in said arranging direction, to scan said plural check dot trains by said pixels.

6. A printing head inspecting device as defined in claim 5, wherein said plural photo receptor elements are arranged at a pitch of said plural check dot trains.

7. A printing head inspecting device as defined in claim 2, wherein said inspection sensor includes a single photo receptor element;

further comprising a scanning mechanism for moving said inspection sensor in said arranging direction;

wherein while said recording material is moved in said crosswise direction, said inspection sensor scans said plural check dot trains on said recording material.

8. A printing head inspecting device as defined in claim 2, wherein said inspection sensor includes plural photo receptor elements for reading said density of said plural check dot trains.

9. A printing head inspecting device as defined in claim 8, wherein said plural photo receptor elements are arranged at a pitch of said recording elements.

10. A printing head inspecting device as defined in claim 8, wherein said plural photo receptor elements are arranged at a pitch greater than a pitch of said recording elements;

further comprising a scanning mechanism for moving said inspection sensor in said arranging direction according to said pitch of said recording elements;

wherein while said recording material is moved in said crosswise direction, said inspection sensor scans said plural check dot trains on said recording material.

11. A printing head inspecting device as defined in claim 2, wherein n=1, said first check dot train includes dots printed by recording elements of odd numbers among said recording elements, and said second check dot train includes dots printed by recording elements of even numbers among said recording elements.

12. A printing head inspecting device as defined in claim 2, wherein n=3, and said plural check dot trains are first to fourth check dot trains.

13. A printing head inspecting device as defined in claim 1, wherein said printing head is an ink jet printing head, said recording elements are nozzles;

said plural check dot trains are adapted to inspection of a state of said nozzles to eject ink.

14. A printing head inspecting device for a printer including a printing head having an array of plural recording elements, and a moving mechanism for moving one of said printing head and recording material relative to a remainder thereof in a direction perpendicular to said recording elements, for printing at least one image to said recording material, said printing head inspecting device comprising:

a controller for causing said moving mechanism to set said printing head sequentially to plural line positions in said recording material, and for, while said printing head is set in one of said line positions, driving said printing head in such a manner that m adjacent recording elements of said recording elements according to said arranging direction are driven, and that n of said recording elements per said recording elements are kept turned off, to print a check dot train to include m adjacent dots per one blank as large as n dots, where m is an integer equal to or more than 2 and n is an integer equal to or more than 2 and equal to or more than m, and for driving said recording elements in said manner with a difference in said line positions and a difference in said recording elements, to print first to (n+1)th check dot trains respectively to include m adjacent dots per one blank as large as n dots; and an inspection sensor for detecting print densities of said first to (n+1)th check dot trains to determine whether said recording elements are functioning properly.

15. A printing head inspecting device as defined in claim 14, wherein said inspection sensor includes plural photo receptor elements arranged in said arranging direction, for, while said recording material is moved in said crosswise direction, reading said density of said plural check dot trains by pixels.

16. A printing head inspecting device as defined in claim 15, wherein each of said pixels is formed by said m adjacent recording elements, and a range of each of said plural photo receptor elements corresponds to a range of said m adjacent recording elements.

17. A printing head inspecting device as defined in claim 16, wherein m=2 and n=2.

18. A printing head inspecting method for a printer including a printing head having an array of plural recording elements, and a moving mechanism for moving one of said printing head and recording material relative to a remainder thereof in a direction perpendicular to said recording elements, for printing at least one image to said recording material, said printing head inspecting method comprising steps of:

causing said moving mechanism to set said printing head sequentially to plural line positions in said recording material;

while said printing head is set in one of said line position, driving said printing head in such a manner that one of said recording elements is driven, and that n adjacent recording elements thereof per said one recording element are kept turned off according to said arranging direction to print a check dot train to include one dot per one blank as large as n adjacent dots, where n is an integer equal to or more than 1, said printing head being driven in said manner with a difference in said line positions and a difference in said recording elements, to print first to (n+1)th check dot trains respectively to include one dot per one blank as large as n adjacent dots; and detecting print densities of said first to (n+1)th check dot trains, to determine whether said recording elements are functioning properly.

19. A printing head inspecting method as defined in claim 18, wherein said plural line positions are located upstream or downstream from said at least one image in said recording material.

20. A printing head inspecting method as defined in claim 19, wherein said step of inspecting said recording elements includes designating failing ones of said plural recording elements associated with pixels with said density being low in said plural check dot trains.

21. A printing head inspecting method as defined in claim 18, wherein said printing head is an ink jet printing head, said recording elements are nozzles;

said plural check dot trains are adapted to inspection of a state of said nozzles to eject ink.

22. A printing head inspecting method for a printer including a printing head having an array of plural recording elements, and a moving mechanism for moving one of said printing head and recording material relative to a remainder thereof in a direction perpendicular to said recording elements for printing at least one image to said recording material said printing head inspecting method comprising steps of:

causing said moving mechanism to set said printing head sequentially to plural line positions in said recording material;

while said printing head is set in one of said line positions, driving said printing head in such a manner that m adjacent recording elements of said recording elements according to said arranging direction are driven, and that n of said recording elements per said m recording elements are kept turned off, to print a check dot train to include m adjacent dots per one blank as large as n dots, where m is an integer equal to or more than 2, and n is an integer equal to or more than 2 and equal to or more than m, said printing head being driven in said manner with a difference in said line positions and a difference in said recording elements, to print first to (n+1)th check dot trains respectively to include m adjacent dots per one blank as large as n dots; and detecting print densities of said first to (n+1)th check dot trains, to determine whether said recording elements are functioning properly.

23. A printing head inspecting method as defined in claim 22, wherein said m adjacent recording elements form each one pixel, and said plural check dot trains are detected pixel by pixel.

24. A printing head inspecting method as defined in claim 23, wherein m=2 and n=2.

25. A printer comprising:

a printing head having an array of plural recording elements;

a moving mechanism for moving one of said printing head and recording material relative to a remainder thereof in a direction perpendicular to said recording elements, for printing at least one image to said recording material;

a controller for causing said moving mechanism to set said printing head sequentially to plural line positions in said recording material, and for, while said printing head is set in one of said line positions, driving said printing head in such a manner that n adjacent recording elements thereof per said one recording element are kept turned off according to said arranging direction, to print a check dot train to include one dot per one blank as large as n adjacent dots, where n is an integer equal to or more than 1, and for driving said recording elements in said manner with a difference in said line positions and a difference in said recording elements to print first to (n+1)th check dot trains respectively to include one dot per one blank as large as n adjacent dots; and an inspection sensor for detecting print densities of said first to (n+1)th check dot trains, to determine whether said recording elements are functioning properly.

* * * * *